US010562155B2

(12) United States Patent
Boutorine

(10) Patent No.: US 10,562,155 B2
(45) Date of Patent: Feb. 18, 2020

(54) REMOVABLE AND REPOSITIONABLE SHARPENING ANGLE GUIDE

(71) Applicant: Oleg Boutorine, Brooklyn, NY (US)

(72) Inventor: Oleg Boutorine, Brooklyn, NY (US)

( * ) Notice: Subject to any disclaimer, the term of this patent is extended or adjusted under 35 U.S.C. 154(b) by 149 days.

(21) Appl. No.: 15/231,450

(22) Filed: Aug. 8, 2016

(65) Prior Publication Data

US 2017/0312890 A1 Nov. 2, 2017

Related U.S. Application Data

(60) Provisional application No. 62/329,188, filed on Apr. 28, 2016.

(51) Int. Cl.
*B24D 15/08* (2006.01)

(52) U.S. Cl.
CPC ..... *B24D 15/08* (2013.01)

(58) Field of Classification Search
CPC ..... B24D 14/06; B24D 14/065; B24D 14/08; B24D 14/105; B24B 3/36; B24B 41/065
USPC ..... 451/349, 371, 555, 558
See application file for complete search history.

(56) References Cited

U.S. PATENT DOCUMENTS

| | | | | |
|---|---|---|---|---|
| 4,197,677 A * | 4/1980 | Graves | B24D 15/06 | 451/555 |
| 5,431,070 A * | 7/1995 | Thames | B24D 15/08 | 76/84 |
| 7,874,896 B1 * | 1/2011 | Watson | B24D 15/08 | 451/371 |
| RE43,884 E * | 1/2013 | Friel, Sr. | B24D 15/065 | 451/349 |
| 9,039,494 B1 * | 5/2015 | Dovel | B24B 3/54 | 451/349 |
| 2006/0141916 A1 * | 6/2006 | McCowen | B24D 15/08 | 451/349 |
| 2008/0039001 A1 * | 2/2008 | Evans | B24D 15/08 | 451/558 |
| 2014/0242895 A1 * | 8/2014 | Krent | B24D 15/08 | 451/555 |
| 2015/0140909 A1 * | 5/2015 | Stanley | B24D 15/06 | 451/371 |

FOREIGN PATENT DOCUMENTS

| | | | |
|---|---|---|---|
| AU | 2014100926 A4 * | 9/2014 | |
| GB | 329546 A * | 5/1930 | B24D 15/08 |
| WO | WO 2004037488 A1 * | 5/2004 | |

OTHER PUBLICATIONS

Machine Translation of AU 2014100926 A4.*

* cited by examiner

*Primary Examiner* — George B Nguyen
(74) *Attorney, Agent, or Firm* — Changi Wu; Changi Wu Law Office

(57) ABSTRACT

A removable and repositionable sharpening tool angle guide for a sharpening tool comprising an angle guide body, and a fastening and detaching means, wherein angle guide body can be attached to or detached from the sharpening tool by the fastening and detaching means, wherein the angle guide body further comprises at least one guide surface, wherein the at least one guide surface of the angle guide body and the sharpening tool forms a degree between about 1 degree to about 89 degrees, and wherein the angle guide body further comprises at least one fastening surface contacted with the sharpening tool.

2 Claims, 9 Drawing Sheets

REMOVABLE AND REPOSITIONABLE SHARPENING ANGLE GUIDE

CROSS-REFERENCE RELATED TO RELATED APPLICATIONS

This application claims the benefit and the priority of U.S. Provisional Application No. 62/329,188, filed Apr. 28, 2016, which is hereby incorporated herein by reference in its entirety.

BACKGROUND

For sharpening knives, it is very important to keep constant angle at which blade contacts sharpening device. Changing angle will result in mis-sharpening or damaging blade edge. Sharpening devices such as sharpening or honing or steeling rods may have integrated angle guides. Those sharpening tools have angle guides affixed or firmly attached on the sharpening tools. Each sharpening tool can have only an angle guide with one specific angle. However, different knives have different shapes and need to be sharpened at different angles between knife blade surface and surface of the sharpening device. Therefore, it will need more than one knife sharpening tools when there are more than one type of knife needs to be sharpened. That is ineffective and costly.

Another issue of the disclosed sharpening tools with fixed angle guide is that their angle guides cannot be repositioned to another section of the sharpening tool when the section of the sharpening tool adjacent to the fixed angle guide has been worn out. Thus, the sharpening tools with fixed angle guide are inconvenient, cost ineffective, and need large spaces to store multiple sharpening tools.

BRIEF SUMMARY OF THE INVENTION

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims. The removable and repositionable angle guide of the present invention overcomes the shortfalls of known knife angle guides. The removable and repositionable angle guide of the present invention is directed to a removable and repositionable removable and repositionable sharpening tool angle guide for a sharpening tool comprising an angle guide body and a fastening and detaching means, wherein angle guide body can be attached to or detached from the sharpening tool by the fastening and detaching means, wherein the angle guide body further comprises at least one guide surface, wherein the at least one guide surface of the angle guide body and the sharpening tool forms a degree between about 1 degree to about 89 degrees, and wherein the angle guide body further comprises at least one fastening surface contacted with the sharpening tool.

The removable and repositionable angle guide is easy to be attached and detached from any sharpening tools of any shapes and styles, so that the removable and repositionable angle guides that have different angles can be attached and detached to same sharpening tool. Therefore, there is no need to have many different sharpening tools that have fixed angle guides. Also, the removable and repositionable angle guide can be easily detached from one direction and attached in a reverse direction or be moved up or down the body of a sharpening tool; therefore, it can utilize a great portion of the sharpening tool than the sharpening tool having fixed angle guide.

BRIEF DESCRIPTION OF THE DRAWINGS

It should be understood that the drawings are merely representative, are not necessarily drawn to scale, and are not intended to limit the subject matter of this application.

DETAILED DESCRIPTION

Figure 1:
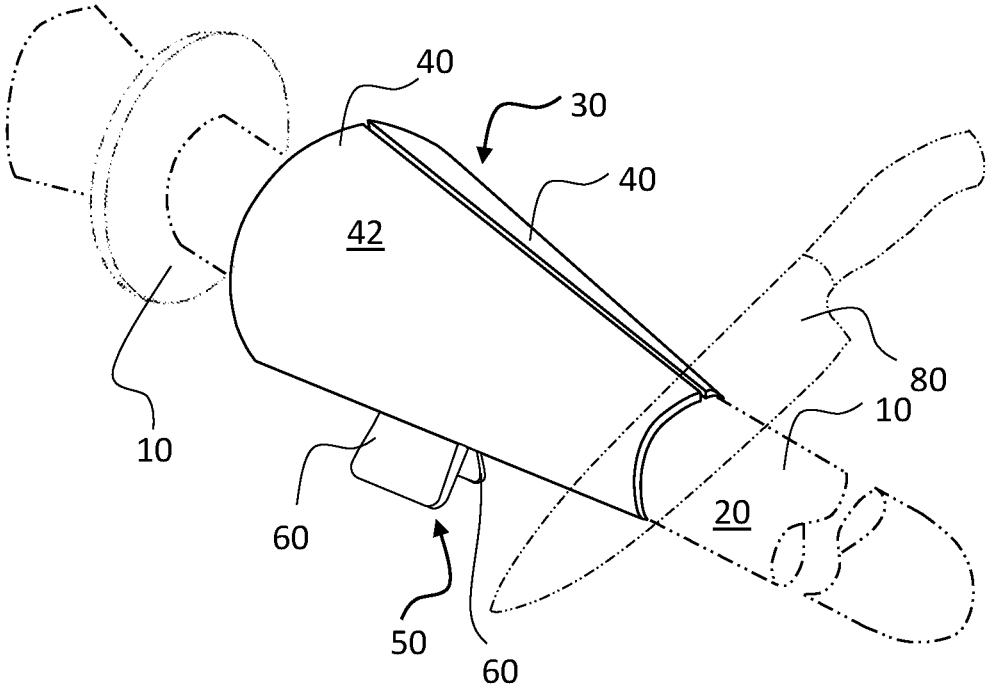
FIG. 1 is a perspective view of one preferred embodiment of the removable and repositionable sharpening tool angle guide when the angle guide body is conic.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Figure 2:
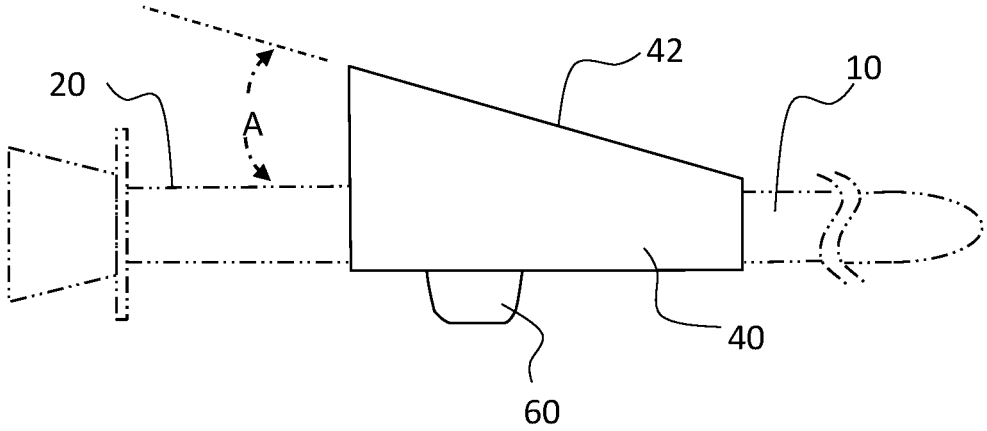
FIG. 2 is an side view from the back of one preferred embodiment of the removable and repositionable sharpening tool angle guide when the angle guide is conic.
Figure 3:
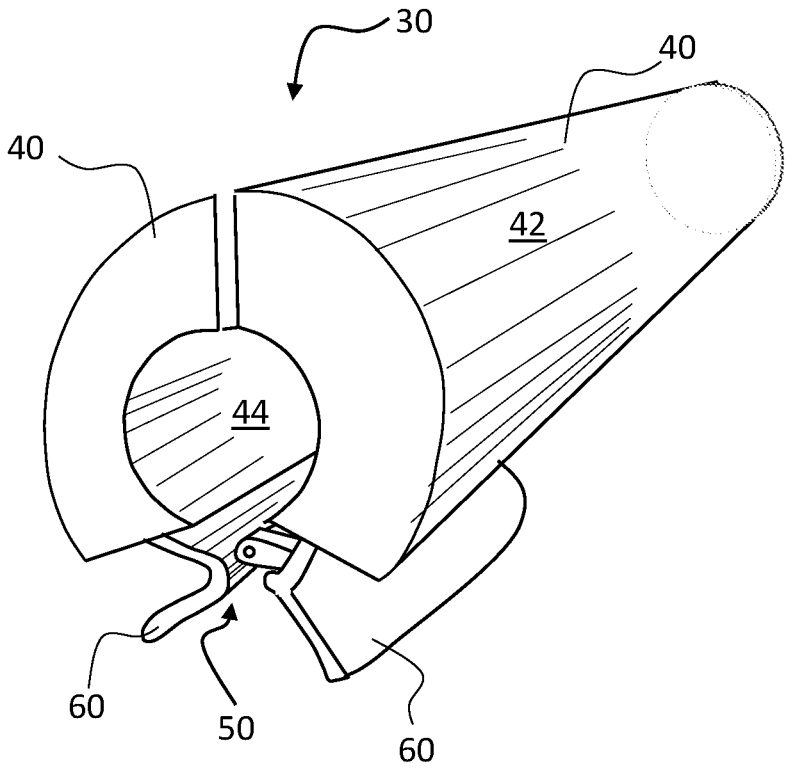
FIG. 3 is a perspective view from the back of another embodiment of the removable and repositionable sharpening tool angle guide when the angle guide body is conic.

Referring to FIG. 1, FIG. 2, and FIG. 3, one of the embodiments of a removable and repositionable sharpening tool angle guide 30 comprises an angle guide body 40 and a fastening and detaching means 50 for fastening and detaching the removable and repositionable sharpening tool angle guide 30 to a sharpening tool 10, wherein the angle guide body 40 is affixed on the fastening and detaching means 50, wherein the angle guide body 40 further comprising at least one guide surface 42 and at least one fastening surface 44 (FIG. 3). In one of preferred embodiments, the fastening and detaching means 50 is a clip 60. When the clip 60 is pressed, the removable and repositionable sharpening tool angle guide 30 can be detached for removal or reposition of the removable and repositionable sharpening tool angle guide 30. A knife 80 can be placed against the at least one guide surface 42 and follow the at least one guide surface 42 to move down to the tool surface 20 of sharpening tool 10 when sharpening the knife 80. The material of the angle guide body 40 can be any material that can provide support, such as but not limited to steel, stainless, alloy, aluminum, porcelain, high density polyester, plastics, rubbers, reinforced glass fiber or combination of thereof. The fastening and detaching means 50 can be the mechanics commonly used to fasten things to another, such as but not limited to clamp, clip, gripper, magnet, C-shape flexible clip. The material of the fastening and detaching means 50 can be commonly used material, such as but not limited to metal, wood, stone, glass, reinforce glass fiber, rubber, synthetic rubber, plastic, or thermoplastic, synthetic resign, fiberglass, or engineered polymer products, or combination thereof. The tool surface 20 of sharpening tool 10 can be round rod, elliptical, flat, or combination thereof.

Referring to FIG. 2, in one of the embodiment of the removable and repositionable sharpening tool angle guide 30, the angle guide body 40 is conical and the at least one guide surface 42 is curved, wherein the at least one guide surface 42 forms an angle A with the tool surface 20 of the sharpening tool 10, and wherein the angle A is between about 89 degrees and about 1 degree.

Referring to FIG. 3, in one embodiment of the removable and repositionable sharpening tool angle guide 30, the removable and repositionable sharpening tool angle guide 30 is detached from said the tool surface 20 (FIG. 1) of the sharpening tool 10 (FIG. 1). The removable and repositionable sharpening tool angle guide 30 comprises an angle guide body 40, a fastening and detaching means 50, wherein the fastening and detaching means 50 comprises a clip 60, wherein the angle guide body 40 further comprises a guide surface 42 and a fastening surface 44 opposed to the guide surface 42.

Figure 4:
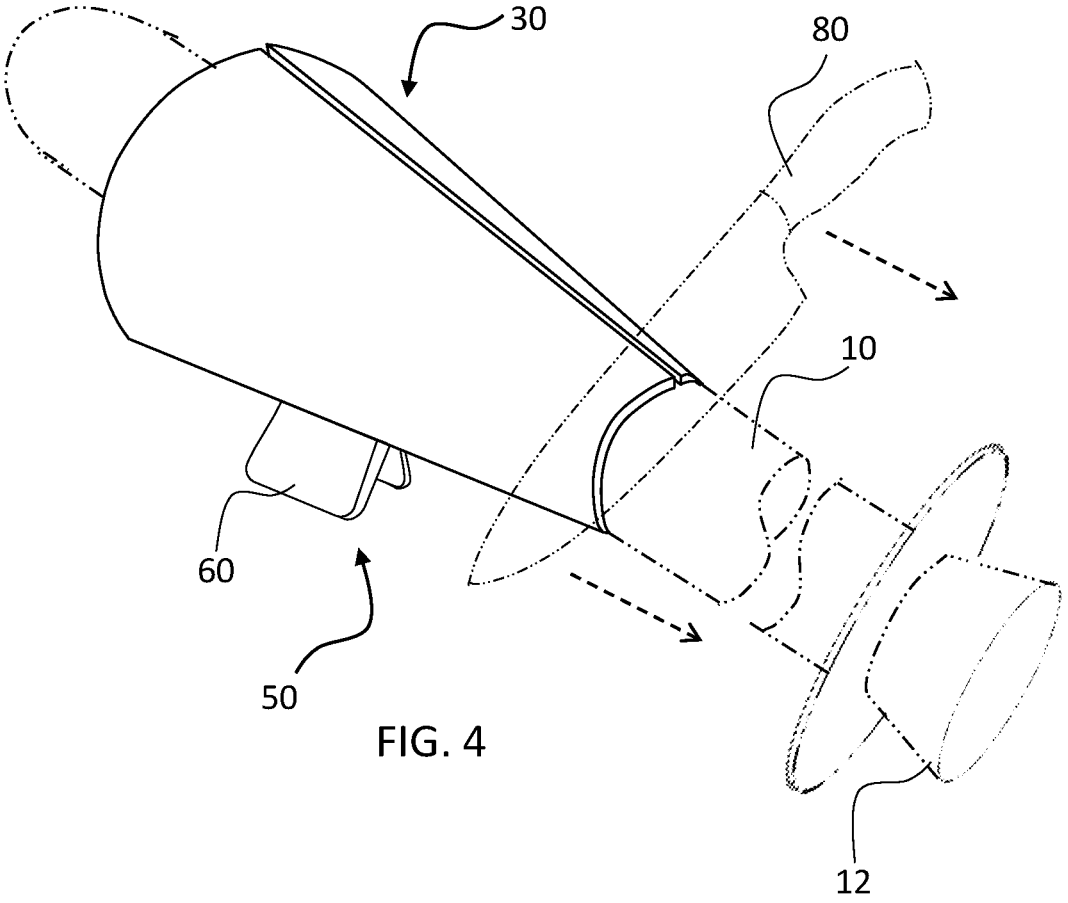
FIG. 4 is a perspective view showing one preferred embodiment of the removable and repositionable sharpening tool angle guide can be attached in another direction.

Referring to FIG. 4, one of the embodiments of the removable and repositionable sharpening tool angle guide 30 can be fastened to the sharpening tool 10 in another direction as opposite to the direction of the removable and repositionable sharpening tool angle guide 30 fastened on the sharpening tool 10 in FIG. 1. The knife 80 to be sharpened will move toward to the handle 12 of the sharpening tool 10.

Figure 5:
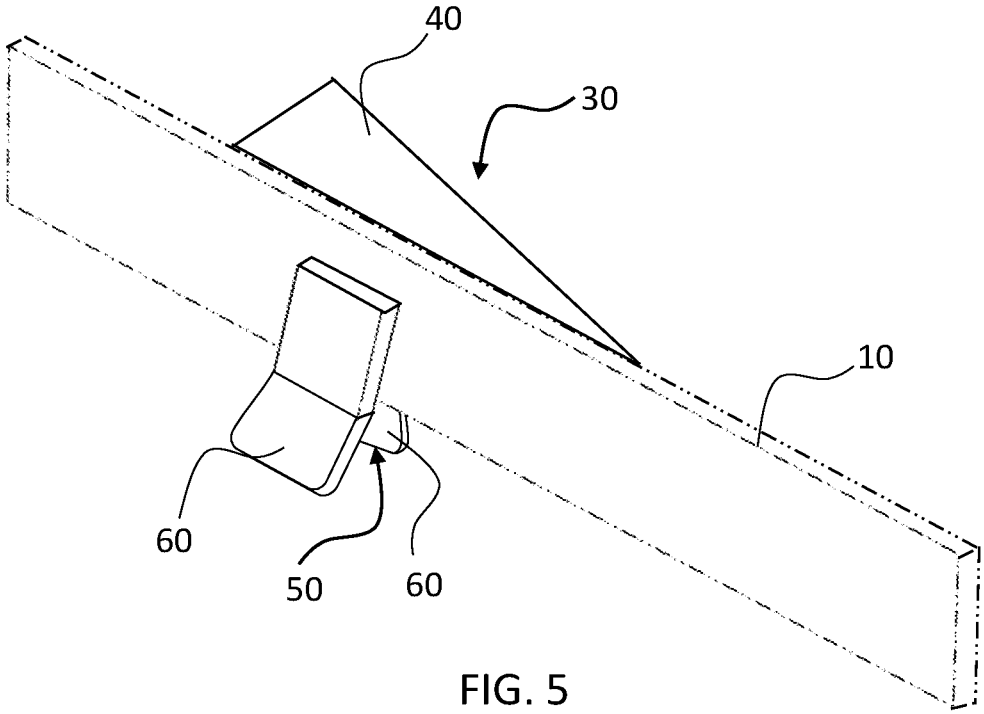
FIG. 5 is a perspective view from the bottom of one preferred embodiment of the removable and repositionable sharpening tool angle guide when the guide surface is flat.
Figure 6:
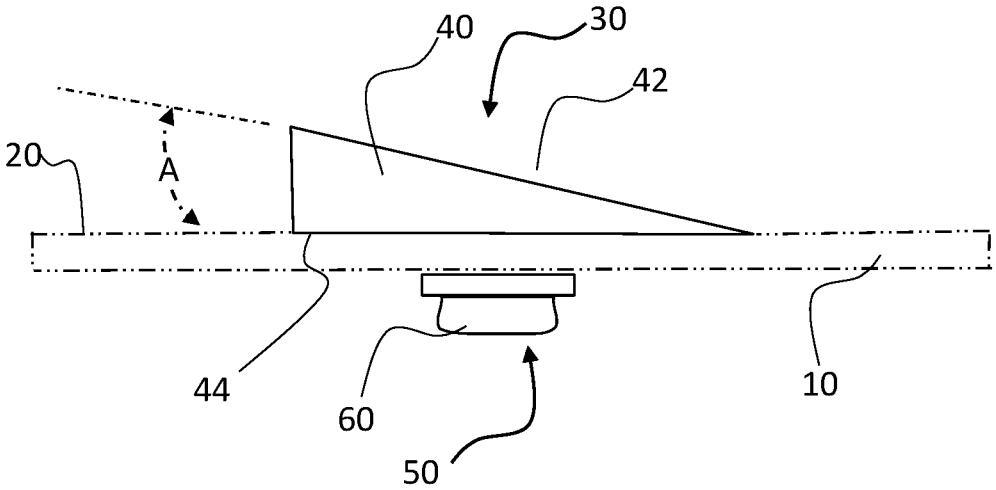
FIG. 6 is a side view showing of one preferred embodiment of the removable and repositionable sharpening tool angle guide attached on a sharpening tool when the guide surface is flat.

Referring to FIG. 5 and FIG. 6, one of the embodiments of the sharpening tool 10 has tool surface 20 that is flat. The removable and repositionable sharpening tool angle guide 30 comprises an angle guide body 40 and a fastening and detaching means 50 to attach the angle guide body 40 to a sharpening tool 10 or to detach the angle guide body 40 from a sharpening tool 10, wherein the angle guide body 40 is affixed on the fastening and detaching means 50, wherein the angle guide body 40 further comprising at least one guide surface 42 and at least one fastening surface 44. In one of the embodiments, the fastening and detaching means 50 is a clip 60. When the clip 60 is pressed, the removable and repositionable sharpening tool angle guide 30 can be detached for removal or reposition of the removable and repositionable sharpening tool angle guide 30. In one embodiment, the angle guide body 40 is a prism and the at least one guide surface 42 is flat, wherein the at least one guide surface 42 forms an angle A with the tool surface 20 of the sharpening tool 10, and wherein the angle A is between about 89 degrees and about 1 degree.

Figure 7:
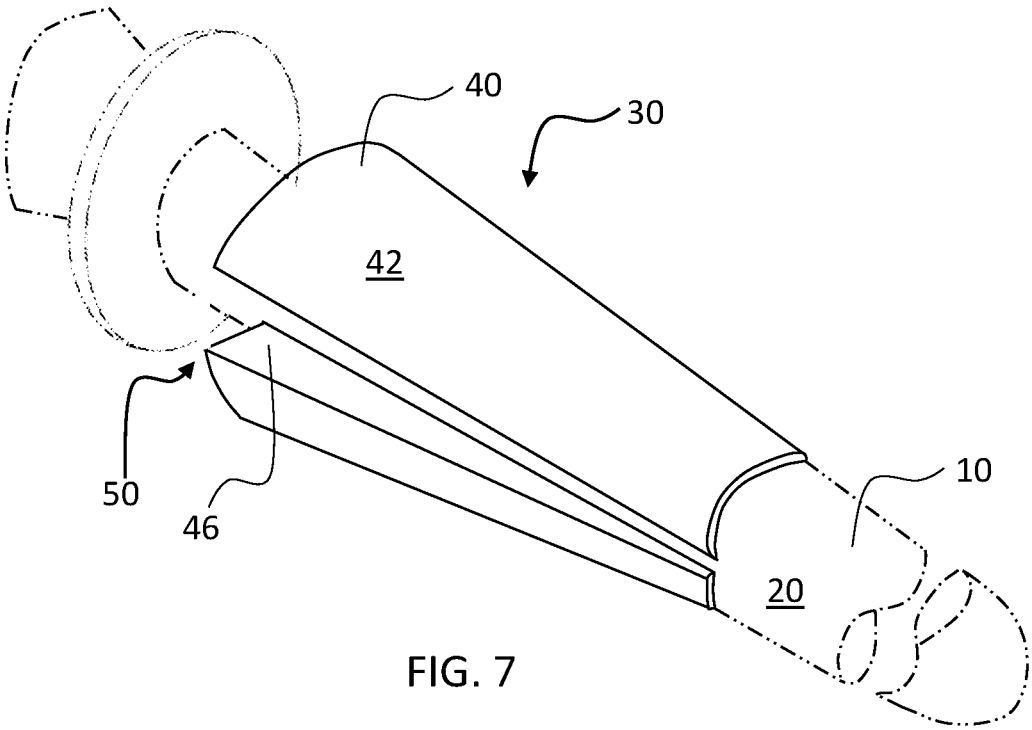
FIG. 7 is a perspective view from the top of one preferred embodiment of the removable and repositionable sharpening tool angle guide using flexible material.
Figure 8:
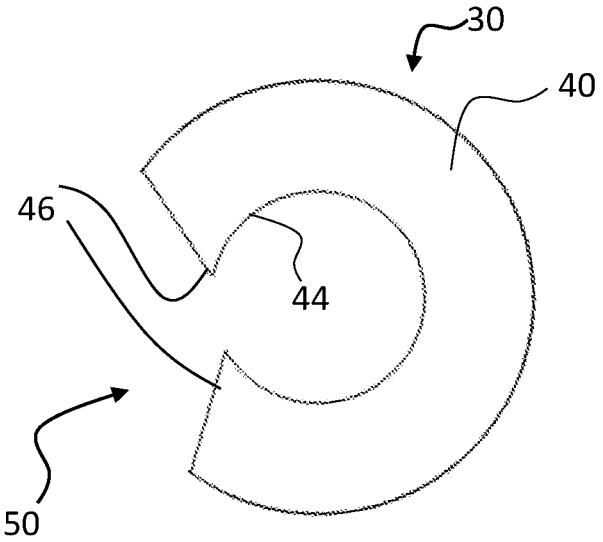
FIG. 8 is a rear view of one preferred embodiment of the removable and repositionable sharpening tool angle guide using C-shape flexible clip as a fastening and detaching means.
Figure 9:
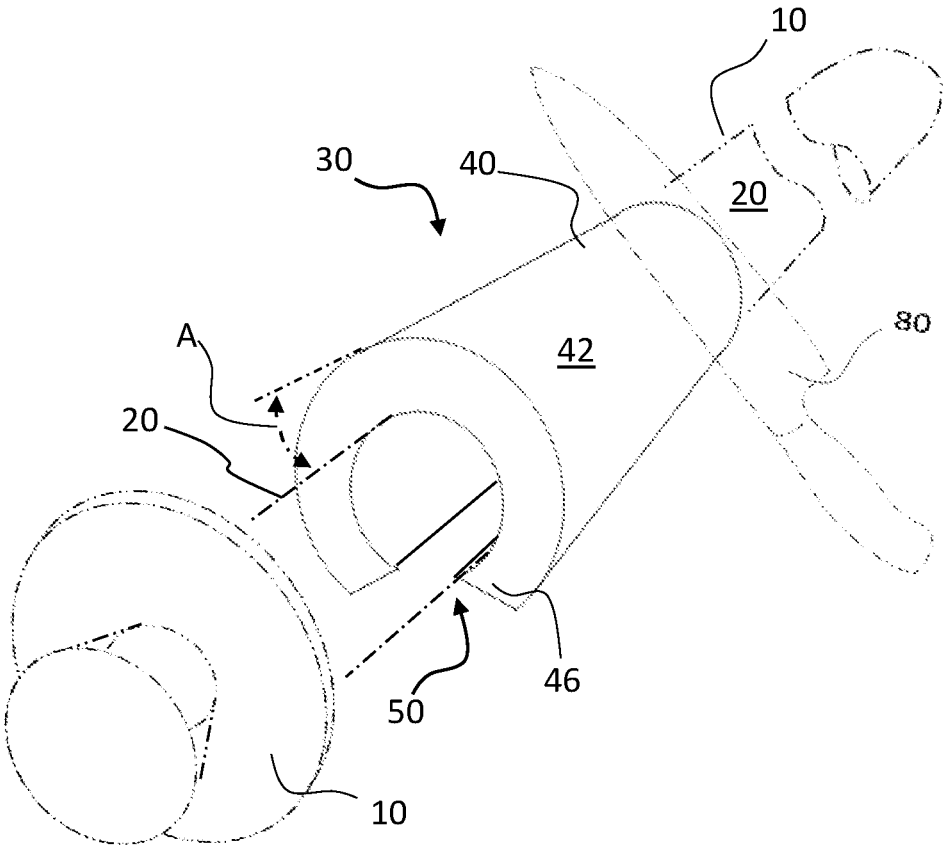
FIG. 9 is a rear perspective view from the back of one preferred embodiment of the removable and repositionable sharpening tool angle guide using C-shape flexible clip as a fastening and detaching means.

Referring to FIG. 7, FIG. 8, and FIG. 9, in one embodiment of the removable and repositionable sharpening tool angle guide 30, a removable and repositionable sharpening tool angle guide 30 comprises an angle guide body 40 and a fastening and detaching means 50 for fastening and detaching the removable and repositionable sharpening tool angle guide 30 to a sharpening tool 10, wherein the angle guide body 40 is affixed on the fastening and detaching means 50, wherein the angle guide body 40 further comprising at least one guide surface 42 and at least one fastening surface 44 (FIG. 8). The at least one guide surface 42 forms an angle A with the tool surface 20 of the sharpening tool 10, and wherein the angle A is between about 89 degrees and about 1 degree.

Referring to FIG. 7, FIG. 8, and FIG. 9, one of the embodiments of the removable and repositionable sharpening tool angle guide 30 uses a resiliently flexible material for the angle guide body 40, such as but not limited to be natural rubber, synthetic rubber, plastic, or thermoplastic, synthetic resign, fiberglass, or engineered polymer products, or combination thereof. In one embodiment, the fastening and detaching means 50 has at least one fastening surface 44 in a round shape to form a C-shape flexible clip 46 and an angle guide body 40 using resiliently flexible material, which defines C-shape flexible clip 46. The removable and repositionable sharpening tool angle guide 30 can be snapped on the sharpening tool 10 and fastened on the sharpening tool 10 because of the contraction and traction force provided by the c-shape flexible clip 46 and the at least one fastening surface 44 in semi-circular C shape, so that the contraction of the C-shape flexible clip 46 will attach the angle guide body 40 to the sharpening tool 10. When detaching the removable and repositionable sharpening tool angle guide 30 from the sharpening tool 10 is desired, the angle guide body 40 and the C-shape flexible clip 46 can be deformed to allow the c-shape flexible clips 46 to open wider and detach the removable and repositionable sharpening tool angle guide 30 from the sharpening tool 10.

Figure 10:
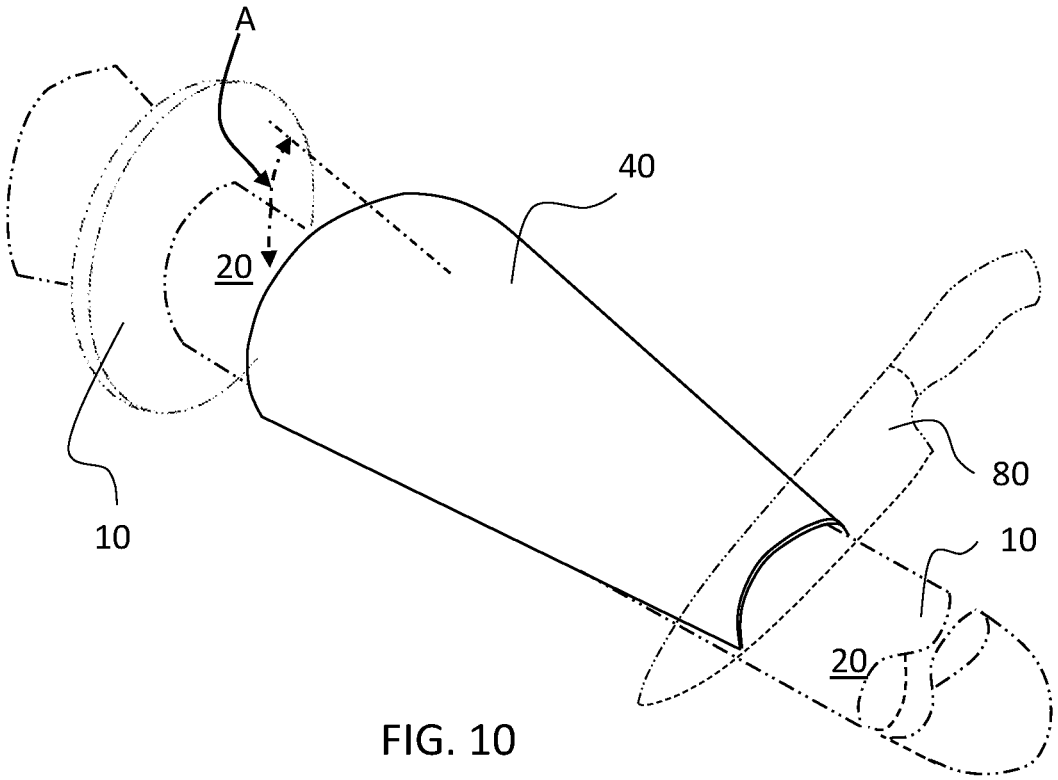
FIG. 10 is a perspective view from the top of one preferred embodiment of the removable and repositionable sharpening tool angle guide using magnet as a fastening and detaching means.
Figure 11:
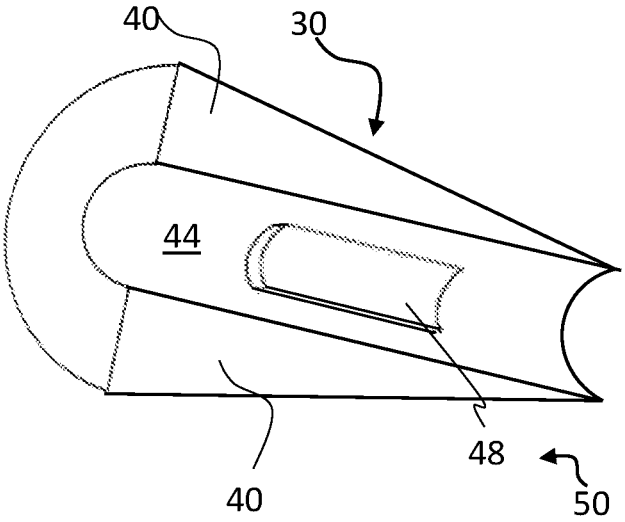
FIG. 11 is a perspective view from the bottom of one preferred embodiment of the removable and repositionable sharpening tool angle guide using magnet as a fastening and detaching means.

Referring to FIG. 10 and FIG. 11, in one of embodiments, a removable and repositionable sharpening tool angle guide 30 comprises an angle guide body 40 and a fastening and detaching means 50 for fastening and detaching the removable and repositionable sharpening tool angle guide 30 to a sharpening tool 10, wherein the angle guide body 40 is affixed on the fastening and detaching means 50, wherein the angle guide body 40 further comprising at least one guide surface 42 and at least one fastening surface 44. The sharpening tool 10 has a tool surface 20 that is a round surface. A knife 80 can be placed against the at least one guide surface 42 and follow the at least one guide surface 42 to move down to the tool surface 20 of sharpening tool 10 when sharpening the knife 80. The at least one guide surface 42 forms an angle A with the tool surface 20 of the sharpening tool 10, and wherein the angle A is between about 89 degrees and about 1 degree. In one embodiment, the fastening and detaching means 50 comprises at least one magnet 48. By the magnetic attraction provided by the at least one magnet 48, the removable and repositionable sharpening tool angle guide 30 can be attached to a tool surface 20 of the sharpening tool 10 that is made of magnetic metal. The at least one magnet 48 for the fastening and detaching means 50 can be affixed on the at least one fastening surface 44 or embedded in the angle guide body 40. The material of the angle guide body 40 can be commonly used material, such as but not limited to metal, wood, stone, glass, reinforce glass fiber, rubber, synthetic rubber, plastic, or thermoplastic, synthetic resign, fiberglass, or engineered polymer products, or combination thereof.

Figure 12:
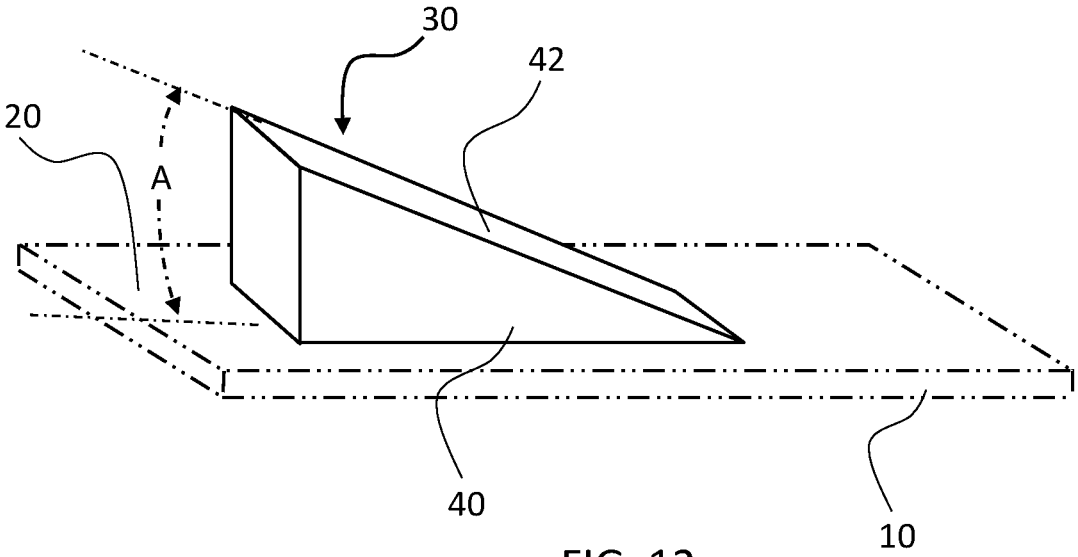
FIG. 12 is a perspective view from the top of one preferred embodiment of the removable and repositionable sharpening tool angle guide using magnet as a fastening and detaching means.
Figure 13:
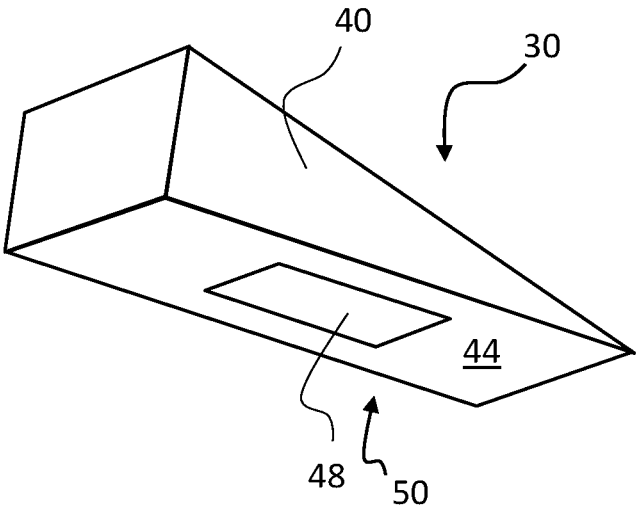
FIG. 13 is a perspective view from the bottom of one preferred embodiment of the removable and repositionable sharpening tool angle guide using magnet as a fastening and detaching means.

Referring to FIG. 12 and FIG. 13, in one of embodiments, a removable and repositionable sharpening tool angle guide 30 comprises an angle guide body 40 and a fastening and detaching means 50 for fastening and detaching the removable and repositionable sharpening tool angle guide 30 to a sharpening tool 10, wherein the angle guide body 40 is affixed on the fastening and detaching means 50, wherein the angle guide body 40 further comprising at least one guide surface 42 and at least one fastening surface 44. The sharpening tool 10 has a tool surface 20 that is flat. The at least one guide surface 42 forms an angle A with the tool surface 20 of the sharpening tool 10, and wherein the angle A is between about 89 degrees and about 1 degree. In one embodiment, the fastening and detaching means 50 comprises at least one magnet 48. By the magnetic attraction provided by the at least one magnet 48, the removable and repositionable sharpening tool angle guide 30 can be attached to a sharpening tool 10 that is made of magnetic metal. The at least one magnet 48 for the fastening and detaching means 50 can be affixed on the at least one fastening surface 44 or embedded in the angle guide body 40. The material of the angle guide body 40 can be commonly used material, such as but not limited to metal, wood, stone, glass, reinforce glass fiber, rubber, synthetic rubber, plastic, or thermoplastic, synthetic resign, fiberglass, or engineered polymer products, or combination thereof.

Figure 14:
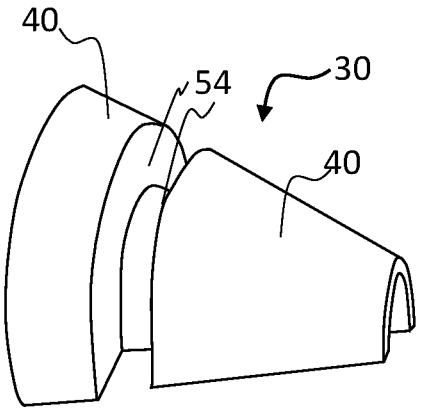
FIG. 14 is a perspective view from the top of one preferred embodiment of the removable and repositionable sharpening tool angle guide.
Figure 15:
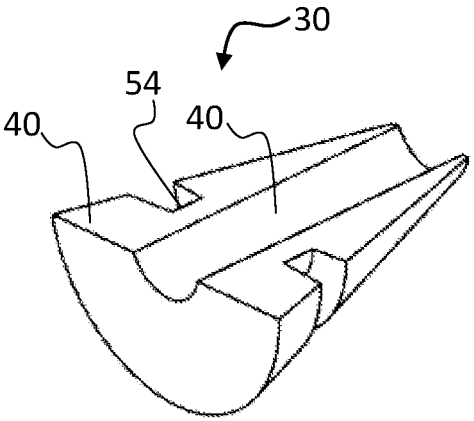
FIG. 15 is a perspective view from the bottom of one preferred embodiment of the removable and repositionable sharpening tool angle guide.
Figure 16:
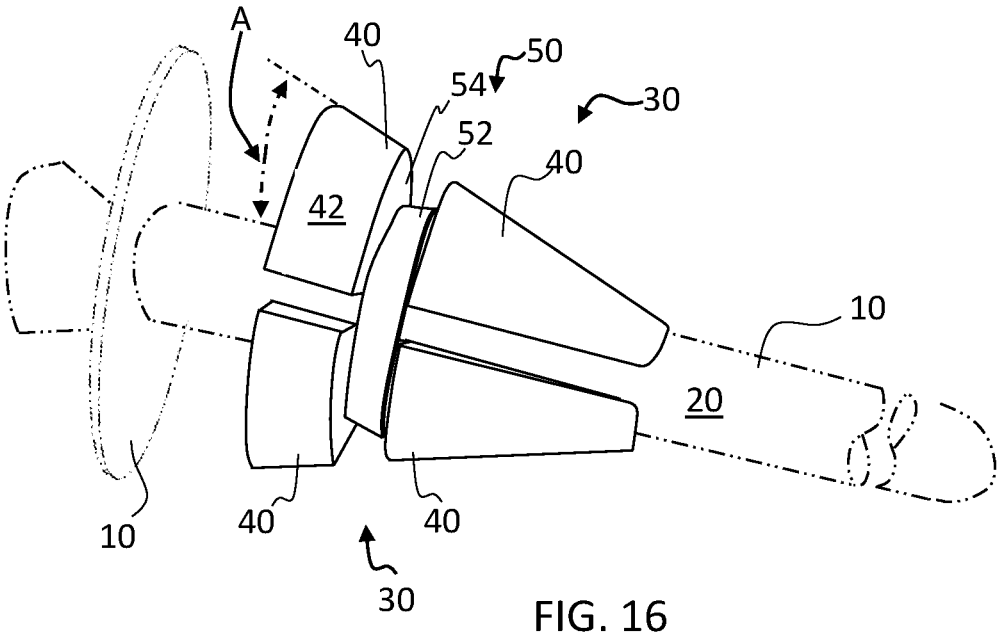
FIG. 16 is a perspective view from the top of one preferred embodiment of the removable and repositionable sharpening tool angle guide attached on the sharpening tool.

Referring to FIG. 14, FIG. 15, and FIG. 16, in one of embodiments, a removable and repositionable sharpening tool angle guide 30 comprises an angle guide body 40 and a fastening and detaching means 50 for fastening and detaching the removable and repositionable sharpening tool angle guide 30 to a sharpening tool 10, wherein the angle guide body 40 is affixed on the fastening and detaching means 50, wherein the angle guide body 40 further comprising at least one guide surface 42 and at least one fastening surface 44. The at least one guide surface 42 forms an angle A with the tool surface 20 of the sharpening tool 10, and wherein the angle A is between about 89 degrees and about 1 degree. In one embodiment, the fastening and detaching means 50 comprises of at least one unitary elastic band 52 and at least one groove 54 circumferentially formed on the angle guide body 40, wherein the at least one unitary elastic band 52 is wrapped around the at least one groove 54 and the sharpening tool 10 to attach the removable and repositionable sharpening tool angle guide 30 to the sharpening tool 10. To detach the removable and repositionable sharpening tool angle guide 30 from the sharpening tool 10, the at least one unitary elastic band 52 is unwrapped around the at least one groove 54 and the sharpening tool 10. The material of the angle guide body 40 can be commonly used material, such as but not limited to metal, wood, stone, glass, reinforce glass fiber, rubber, synthetic rubber, plastic, or thermoplastic, synthetic resign, fiberglass, or engineered polymer products, or combination thereof What claimed is:

1. A removable and repositionable sharpening tool angle guide for sharping a knife on a sharpening tool comprising:

an angle guide body, wherein said angle guide body further comprises at least one guide surface, wherein said at least one guide surface of said angle guide body and said sharpening tool forms a degree between about 1 degree to about 89 degrees, and wherein said angle guide body further comprises at least one fastening surface contacted with said sharpening tool; and at least one unitary elastic band and at least one groove circumferentially formed on said angle guide body, wherein said at least one unitary elastic band is wrapped around said at least one groove to fasten or detach said angle guide body on said sharpening tool, wherein said angle guide body is fixed and not freely movable when said knife is moved down along said sharpening tool during sharpening said knife.

2. The removable and repositionable sharpening tool angle guide of claim 1, wherein said angle guide body is made of resiliently flexible material.

* * * * *